United States Patent [19]

Laybourne

[11] 4,408,961

[45] Oct. 11, 1983

[54] JET PUMP WITH INTEGRAL PRESSURE REGULATOR

[75] Inventor: Bernard D. Laybourne, Farmington, Conn.

[73] Assignee: Chandler Evans, Inc., West Hartford, Conn.

[21] Appl. No.: 349,009

[22] Filed: Feb. 16, 1982

[51] Int. Cl.[3] ..... F04F 5/48

[52] U.S. Cl. ..... 417/189; 137/508; 239/412; 417/79; 417/87

[58] Field of Search ..... 417/187, 188, 189, 182, 417/177, 79, 87; 239/412; 137/891, 892, 895, 508

[56] References Cited

U.S. PATENT DOCUMENTS

| | | | |
|---|---|---|---|
| 1,814,120 | 7/1931 | Bradbury | 417/189 X |
| 2,457,388 | 12/1948 | Lung | 417/189 X |
| 3,394,884 | 7/1968 | Lord | 137/895 X |
| 3,922,113 | 11/1975 | Turner | 417/189 X |

*Primary Examiner*—Edward K. Look

[57] ABSTRACT

A combined pressure regulator and jet pump includes a valve member and cooperating nozzle defining member which are coaxial and independently movable. Both members are responsive to the difference in upstream and downstream pressures and each member will move relative to the other in response to a predetermined pressure difference. The relative movement between the nozzle defining and valve members will not interrupt the pumping action resulting from fluid flow through the variable area nozzle formed by these members.

14 Claims, 2 Drawing Figures

JET PUMP WITH INTEGRAL PRESSURE REGULATOR

BACKGROUND OF THE INVENTION (1) Field of the Invention

The present invention relates to the delivery of fuel to a consuming load and particularly to exercising control over the inlet pressure to a fuel pump. More specifically, this invention is directed to pressure regulators and especially to variable area jet pumps which simultaneously function as pressure control valves. Accordingly, the general objects of the present invention are to provide novel and improved methods and apparatus of such character.

(2) Description of the Prior Art

While not limited thereto in its utility, the present invention is particularly well suited for use in apparatus for controllably delivering a liquid to a consuming load and particularly for use in fuel controls for gas turbine type engines. Gas turbine engine fuel controls are known wherein the engine fuel inlet nozzles are coupled, by means of a fuel control, to the outlet of a gear type pump which is driven by the engine. A portion of the pressurized fuel discharged from the gear pump is not delivered to the engine but rather is fed back from the fuel control to a jet pump connected upstream of the gear pump. The passage of this pressurized fuel through the jet pump induces a flow of fuel from a supply to the gear pump inlet. In order for the gear pump to operate properly and with maximum efficiency, a predetermined inlet pressure should be maintained. In the prior art this has been accomplished by connecting a pressure control device in the feedback path between the fuel control and the jet pump, the pressure control device also preventing overpressure in the fuel control casing.

Prior attempts to make an integral jet pump-pressure control assembly have failed to provide a device having all of the necessary attributes. Thus, previously proposed pressure control-jet pump subassemblies have been characterized by one or more of a number of deficiencies. These deficiencies include large size, inefficient operation and, most importantly, the inherent operating characteristic of the jet pump not being driven by the feedback flow during those periods of time when the pressure regulator is in the open condition to relieve excess gear pump inlet pressure. Similarly, the prior art devices and systems were rendered inoperative in the case of failure, for example a valve member sticking due to particulate matter contamination, of the pressure regulator.

SUMMARY OF THE INVENTION

The present invention overcomes the above-discussed and other deficiencies and disadvantages of the prior art by providing a novel and improved jet pump with an integral pressure control valve. Apparatus in accordance with the present invention is characterized by a construction and mode of operation wherein the operation of the pressure control valve does not change the functioning of the jet pump. Apparatus in accordance with the present invention is also characterized by the fact that the pressure control feature, which is capable of full by-pass flow with the required pressure drop, may be incorporated within an existing jet pump envelope.

In accordance with a preferred embodiment, the nozzle defining portion of a jet pump is movable relative to a coaxial and separately movable valve member. The nozzle and valve members cooperate to form a variable area nozzle of a jet pump. The nozzle defining member is movable relative to the valve member in response to an over-pressure condition while the valve member is movable relative to the nozzle defining member during normal operating conditions in response to the pressure downstream of the jet pump. The by-pass flow fed back to the jet pump will flow through the variable area nozzle, even under the condition of excess pressure, to drive the jet pump.

BRIEF DESCRIPTION OF THE DRAWING

The present invention may be better understood and its numerous objects and advantages will become apparent to those skilled in the art by reference to the accompanying drawing wherein like reference numerals refer to like elements in the two FIGURES and in which.

DESCRIPTION OF THE PREFERRED EMBODIMENT

Figure 1:
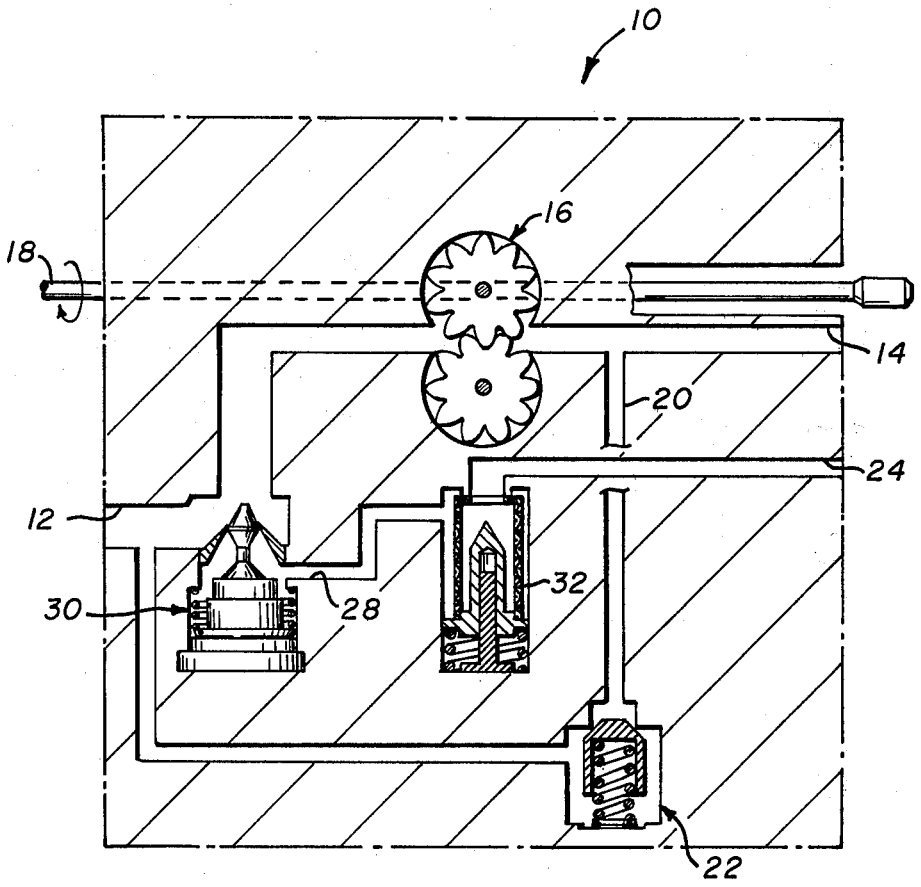
FIG. 1 is a schematic view depicting the present invention in the environment of a gas turbine engine fuel control.

With reference now to the drawing, a portion of a fuel delivery system for a gas turbine engine is indicated in FIG. 1 generally at 10. The fuel delivery system 10, with the exception to be discussed below, is state-of-the-art hardware and thus will not be described in detail herein. A source of combustible fuel, not shown, is connected to an inlet port 12. The fuel is pressurized in apparatus 10 and delivered to a discharge port 14 which is coupled to a fuel control. Pressurization of the fuel is principally accomplished through the use of a gear pump, indicated generally at 16, which is driven by the turbine engine via a drive shaft 18. Gear pump 16 will typically be a fixed displacement pump, i.e., the flow will be fixed for a given speed. The delivery apparatus 10 is provided with a bypass conduit 20 which extends from the discharge side of pump 16 to inlet port 12. An adjustable pressure relief valve 22 is connected in feedback path 20. If engine fuel injection nozzles become clogged, the gear pump discharge pressure will increase and valve 22 will "dump" this pressure by permitting bypass flow back to the pump inlet. Apparatus 10 is further provided with an inlet port 24 which is connected to the fuel control. Inlet port 24 is coupled, via a conduit 28 in apparatus 10, to a combined jet pump and pressure control valve, indicated generally at 30. A filter device 32, which comprises a mesh screen and which preferably also includes a pressure responsive valve, is provided in conduit 28. Filter device 32 protects the jet pump 30 from contamination and the integral valve member will be responsive to the pressure differential across the screen whereby, should the screen become partially clogged by ice or dirt, the feedback flow will not be adversely affected.

In operation of the apparatus depicted in FIG. 1, the fixed displacement gear pump 16 will produce a flow which is in excess of that required by the load. This is particularly true as altitude increases and less fuel is thus consumed. The excess flow will be returned via conduit 28 to the jet pump 30 and, in flowing through jet pump 30, the pressurized excess fuel will in the manner known in the art induce the flow of additional fuel from the source connected to inlet 12. This additional fuel will, of course, be pressurized by pump 16. The fluid fed back via conduit 28 will be at a pressure which is higher than the gear pump inlet pressure but less than the gear pump discharge pressure. The novel combined jet pump and pressure regulator 30 of the present invention serves to regulate the gear pump inlet pressure without adversely effecting the pumping action of the jet pump.

Figure 2:
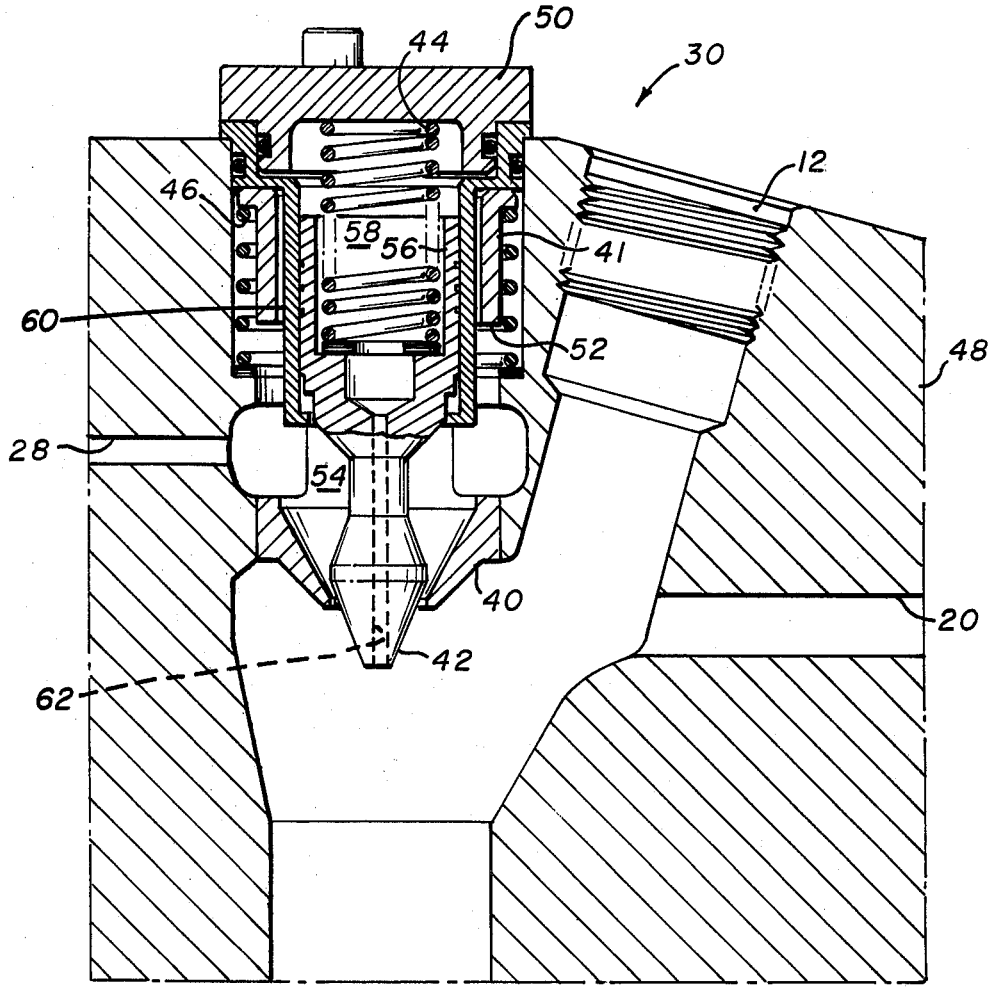
FIG. 2 is a cross-sectional side-elevation view of apparatus in accordance with a preferred embodiment of the invention.

With reference now to FIG. 2, the jet pump-pressure regulator 30 of the present invention comprises a variable orifice jet nozzle which includes a nozzle defining member 40, which has a sleeve extension 41, and a valve member 42. Device 30 also includes a valve regulating spring 44 and a pressure relief spring 46. All of these components are positioned within a bore provided in a housing 48, the bore being sealed from the ambient atmosphere by a cover 50. Both the nozzle defining member 40 and the valve member 42 are longitudinally movable, independently of one another, along a common axis.

The sleeve extension 41 of nozzle defining member 40 is provided with apertures, as indicated at 52, which provide communication between the chamber 54 between the valve and nozzle defining members and the conduit 28. Chamber 54 is thus in fluid communication with the passage 28 through which the pressurized excess fuel is returned from the fuel control.

The cover 50, a fixed sleeve 60 and a tubular extension 56 of valve member 42 define a further chamber 58 which houses valve spring 44, the spring extending between cover 50 and an internal shoulder on the valve member and biasing the valve member toward the minimum flow position. Valve member 42 is further provided with an axial through-hole 62 whereby the gear pump inlet pressure is communicated to chamber 58. The surface areas of valve member 42 which are exposed to the pressure in chamber 54 and to the gear pump inlet pressure are selected such that member 42 will begin to move against the bias of spring 44 when the pressure in chamber 54 exceeds the gear pump inlet pressure by, for example, sixteen psi. Valve member 42 will reach its limit of motion when the pressure in chamber 54 reaches another level such as, for example, twenty-five psi above gear pump inlet. The valve member 42 thus regulates the gear pump inlet pressure, holding the pressure within a preselected range relative to the pressure of the jet pump driving fluid, without interrupting the pumping action of the jet pump.

The valve member 42 slides within the fixed sleeve 60, the sleeve being clamped between cover 50 and housing 48. The sleeve extension 41 of nozzle defining member 40 is positioned outwardly from and is coaxial with sleeve 60. A sliding seal must be established between valve member 42 and sleeve 60 to isolate chamber 54 from chamber 58. Sleeve extension 41, however, is not sealed to sleeve 60 and thus may be spaced therefrom to insure against any possible interference.

The nozzle defining member 40 is configured and its biasing spring 46 selected such that member 40 will not overcome the spring bias until the pressure differential across member 40 exceeds the pressure differential required to move valve member 42 to its limit of motion. For example, if valve member 40 is designed to maintain the downstream gear pump inlet pressure in the range of sixteen to twenty-five psi below the pressure in chamber 54, nozzle defining member 40 will begin to move when the pressure differential thereacross is twenty-eight psi and will be fully open with a pressure differential of thirty-five psi. The movement of member 40 to relieve pressure will not prevent the device of FIG. 2 from continuing to function as an efficient jet pump. It is to be noted that an over-pressure condition that will cause movement of member 40 relative to valve member 42 would result if valve member 42 became seized within sleeve 60 thereby causing a pressure build-up in chamber 54.

While a preferred embodiment has been shown and described, various modifications and substitutions may be made thereto without departing from the spirit and scope of the invention. Accordingly, it is to be understood that the present invention has been described by way of illustrations and not limitation.

What is claimed is:

1. A pressure regulator device comprising:

housing means, said housing means having a fluid flow passage extending therethrough, said housing means defining a first chamber which communicates at one end with said passage, said first chamber having an axis;

valve means, said valve means including a valve member having an axis and a pair of reaction surfaces, said valve member being at least in part positioned in said first chamber and being coaxial therewith;

means for supporting said valve member for axial movement in said first chamber;

nozzle defining means, said nozzle defining means having an axis and being at least in part positioned in said first chamber and circumscribing said valve member, said nozzle defining means being coaxial with said first chamber and axially movable therein relative to said valve member, said nozzle defining means cooperating with said valve member to define therebetween a sensing chamber within said first chamber and a variable area nozzle which communicates between said sensing chamber and said housing means passage, said nozzle defining means having a reaction surface disposed within said sensing chamber whereby the pressure in said sensing chamber will urge said nozzle defining means in a first direction, a first of said valve member reaction surfaces also being disposed within said sensing chamber whereby the pressure in said sensing chamber will urge said valve member in a second direction opposite to said first direction;

means for delivering a fluid at a reference pressure to said sensing chamber; and means for applying the pressure of the fluid in said housing means passage to said valve member second reaction surface to urge said valve member in the said first direction.

2. The apparatus of claim 1 wherein said pressure regulator device also functions as a jet pump and the reference pressure fluid is the driving fluid for said pump, passage of said driving fluid through said variable area nozzle inducing a flow of fluid through said housing means flow passage.

3. The apparatus of claim 2 wherein said valve means second reaction surface is oppositely disposed in said first chamber with respect to the end thereof which communicates with said housing means flow passage and wherein said means for applying pressure to the second reaction surface of said valve member comprises a passage extending axially through said valve member from said housing means flow passage to the interior of said first chamber.

4. The apparatus of claim 2 wherein said nozzle defining means comprises:

a cylindrical sleeve, said reference pressure fluid delivering means including an aperture in said sleeve; and a convergent extension of said sleeve, the surface of said convergent extension which faces said valve member defining said nozzle defining means reaction surface.

5. The apparatus of claim 3 wherein said nozzle defining means comprises:

a cylindrical sleeve, said reference pressure fluid delivering means including an aperture in said sleeve; and a convergent extension of said sleeve, the surface of said convergent extension which faces said valve member defining said nozzle defining means reaction surface.

6. The apparatus of claim 2 further comprising:

means resiliently biasing said nozzle defining means in said second direction whereby said nozzle defining means will move in the first direction to enlarge said variable area nozzle in response to a pressure in said sensing chamber above a first predetermined level.

7. The apparatus of claim 4 further comprising:

means resiliently biasing said nozzle defining means in said second direction whereby said nozzle defining means will move in the first direction to enlarge said variable area nozzle in response to a pressure in said sensing chamber above a first predetermined level.

8. The apparatus of claim 5 further comprising:

means resiliently biasing said nozzle defining means in said second direction whereby said nozzle defining means will move in the first direction to enlarge said variable area nozzle in response to a pressure in said sensing chamber above a first predetermined level.

9. The apparatus of claim 2 wherein said valve means further includes:

means resiliently biasing said valve member in the said first direction, said valve means moving in the said second direction to enlarge said variable area nozzle when the differential of the forces resulting from the pressure acting on said first and second reaction surfaces is opposite to and exceeds the resilient bias.

10. The apparatus of claim 6 wherein said valve means further includes:

means resiliently biasing said valve member in the said first direction, said valve means moving in the said second direction to enlarge said variable area nozzle when the differential of the forces resulting from the pressure acting on said first and second reaction surfaces is opposite to and exceeds the resilient bias.

11. The apparatus of claim 4 wherein said valve means further includes:

means resiliently biasing said valve member in the said first direction, said valve means moving in the said second direction to enlarge said variable area nozzle when the differential of the forces resulting from the pressure acting on said first and second reaction surfaces is opposite to and exceeds the resilient bias.

12. The apparatus of claim 5 wherein said valve means further includes:

means resiliently biasing said valve member in the said first direction, said valve means moving in the said second direction to enlarge said variable area nozzle when the differential of the forces resulting from the pressure acting on said first and second reaction surfaces is opposite to and exceeds the resilient bias.

13. The apparatus of claim 7 wherein said valve means further includes:

means resiliently biasing said valve member in the said first direction, said valve means moving in the said second direction to enlarge said variable area nozzle when the differential of the forces resulting from the pressure acting on said first and second reaction surfaces is opposite to and exceeds the resilient bias.

14. The apparatus of claim 8 wherein said valve means further includes:

means resiliently biasing said valve member in the said first direction, said valve means moving in the said second direction to enlarge said variable area nozzle when the differential of the forces resulting from the pressure acting on said first and second reaction surfaces is opposite to and exceeds the resilient bias.

* * * * *